US010199023B2

(12) United States Patent
Pouillard et al.

(10) Patent No.: US 10,199,023 B2
(45) Date of Patent: Feb. 5, 2019

(54) ELECTRONIC WOODWIND INSTRUMENT

(71) Applicant: AODYO, Villeneuve d'Ascq (FR)

(72) Inventors: Laurent Pouillard, Aubers (FR); Ludovic Potier, Lille (FR)

(73) Assignee: AODYO, Villeneuve d'Ascq (FR)

( * ) Notice: Subject to any disclaimer, the term of this patent is extended or adjusted under 35 U.S.C. 154(b) by 0 days.

(21) Appl. No.: 15/577,596

(22) PCT Filed: May 28, 2016

(86) PCT No.: PCT/FR2016/051278
§ 371 (c)(1),
(2) Date: Nov. 28, 2017

(87) PCT Pub. No.: WO2016/193601
PCT Pub. Date: Dec. 8, 2016

(65) Prior Publication Data

US 2018/0137846 A1 May 17, 2018

(30) Foreign Application Priority Data

May 29, 2015 (FR) ..... 15 54858

(51) Int. Cl.
*G10H 1/32* (2006.01)
*G10H 1/053* (2006.01)

(52) U.S. Cl.
CPC ..... *G10H 1/053* (2013.01); *G10H 1/32* (2013.01); *G10H 2220/361* (2013.01); *G10H 2230/155* (2013.01)

(58) Field of Classification Search
CPC ..... G10H 2220/361; G10H 2250/535; G10H 3/00; G10H 1/348; G10D 9/02; G10D 9/043; G10D 7/123; G10D 7/026
See application file for complete search history.

(56) References Cited

U.S. PATENT DOCUMENTS

| | | | |
|---|---|---|---|
| 3,429,976 | A | 2/1969 | Tomcik |
| 3,429,986 | A | 2/1969 | Rahenkamp |
| 3,767,833 | A | 10/1973 | Noble et al. |
| 5,140,888 | A | 8/1992 | Ito |

(Continued)

FOREIGN PATENT DOCUMENTS

| | | | |
|---|---|---|---|
| EP | 0 039 012 | A1 | 11/1981 |
| JP | 2008-268592 | A | 11/2008 |
| JP | 2014-182277 | A | 9/2014 |

OTHER PUBLICATIONS

International Search Report, dated Sep. 7, 2016, from corresponding PCT application No. PCT/FR2016/051278.

*Primary Examiner* — Marlon Fletcher
(74) *Attorney, Agent, or Firm* — Young & Thompson

(57) ABSTRACT

Disclosed is an electronic woodwind instrument for that allows adjusting the behavior thereof to be adjusted to approach as much as close as possible to that of an acoustic woodwind instrument. The instrument includes a mouthpiece, a body provided with keys and a channel connected to the mouthpiece and leading to the outside of the instrument, at least one pressure sensor configured to deform under the action of breath, and an electronic processing system connected to the keys and the pressure sensor and configured to produce musical notes according to the handling of the keys and the measurement of breath. The channel includes an inlet tube, an outlet tube and an intermediate chamber, the elements being configured to pressurize the chamber when the musician blows into the mouthpiece. The chamber includes a measuring port on to which the pressure sensor is connected.

12 Claims, 3 Drawing Sheets

(56) References Cited

U.S. PATENT DOCUMENTS 5,170,003 A 12/1992 Kawashima
5,286,913 A * 2/1994 Higashi ..... G10H 1/055 84/622
5,403,966 A * 4/1995 Kawashima ..... G10H 1/0553 84/612
5,668,340 A * 9/1997 Hashizume ..... G10D 9/005 84/723
5,929,361 A * 7/1999 Tanaka ..... G09B 15/003 84/380 R
6,002,080 A * 12/1999 Tanaka ..... G10D 7/00 84/609
6,476,310 B1 * 11/2002 Baum ..... G10H 1/06 84/600
9,984,669 B2 * 5/2018 Toyama ..... G10H 3/16
2007/0017352 A1 * 1/2007 Masuda ..... G10H 1/053 84/658
2007/0068372 A1 * 3/2007 Masuda ..... G10H 1/0008 84/723
2008/0314226 A1 * 12/2008 Shibata ..... G10H 1/32 84/384
2009/0019999 A1 * 1/2009 Onozawa ..... G10H 1/34 84/658
2009/0020000 A1 * 1/2009 Onozawa ..... G10D 7/00 84/723
2009/0038463 A1 * 2/2009 Fujii ..... G10D 9/026 84/398
2012/0017749 A1 * 1/2012 Hashimoto ..... G10H 1/053 84/600
2012/0073424 A1 * 3/2012 Hashimoto ..... G10H 1/0008 84/622
2013/0192446 A1 * 8/2013 Read ..... G10H 1/02 84/609
2016/0210949 A1 * 7/2016 Kang ..... G10H 1/32
2016/0275929 A1 * 9/2016 Harada ..... G10H 1/46
2016/0275930 A1 * 9/2016 Harada ..... G10H 1/46
2018/0075831 A1 * 3/2018 Toyama ..... G10H 1/06
2018/0082664 A1 * 3/2018 Sasaki ..... G10B 3/22
2018/0137846 A1 * 5/2018 Pouillard ..... G10H 1/053

* cited by examiner

ELECTRONIC WOODWIND INSTRUMENT

TECHNICAL FIELD

The present invention relates to the field of electronic wind instruments which enable the production of musical notes by positioning the fingers of the hands on keys and by blowing into a mouthpiece. The main purpose of the invention is to improve the behaviour of the electronic wind instrument and to approach as close as possible to that of an acoustic wind instrument, in order to provide the same playing sensation, whereby the musician can continue working on his playing technique and thus progress on both types of instrument.

One of the advantages of electronic wind instruments is to allow musicians to practice a wind instrument under all circumstances, without causing discomfort to people in the vicinity. Indeed, acoustic wind instruments are loud by nature, which does not allow the musician to practise at home, at any time, without disturbing the other members of the family or neighbours. Unless a very expensive and not very comfortable soundproof booth is available. Using electronic wind instruments, musicians can practice silently at home under all circumstances by means of an audio headset, without any discomfort for the neighbours.

Another advantage of an electronic wind instrument is to allow the musician to play in an amplified manner, very simply, so as to integrate with other instruments in a controlled manner.

Another advantage of this type of instrument lies in the fact of being able to separate fingering technique from blowing technique, for learning purposes. Hence, the musician can concentrate on the notes without the need to master a nozzle or a mouthpiece.

Other advantages also exist, for example the possibility of changing the range of playable notes, tuning the instrument in a customised and reproducible manner, and playing different sounds on one and the same instrument.

PRIOR ART

In a first embodiment according to the prior art, the electronic wind instruments comprise a mouthpiece into which the musician blows. A pressure sensor is connected on this mouthpiece, the pressure sensor comprising a membrane which deforms when the musician blows into the mouthpiece. An electronic processing system is connected to the sensor for measuring deformations of the membrane. Keys are also arranged on the instrument and connected to the electronic processing system, said electronic processing system measuring contacts on these keys. The simultaneous action of blowing into the mouthpiece and manipulation of the keys by the musician enables the electronic processing system to produce musical notes. This design does not entirely reproduce the sensation of playing an acoustic wind instrument, given that the musician blows into the mouthpiece of a pipe, the end of which communicates directly with the pressure sensor, this mouthpiece being consequently blocked.

To overcome this disadvantage, an alternative embodiment includes the addition of means for discharging the blown air, which are configured on the mouthpiece or directly on the pressure sensor. This allows air to be exhausted when the musician blows into the mouthpiece and hence provides sensations a little closer to those of an acoustic wind instrument. By way of example, such an electronic wind instrument design appears in U.S. Pat. No. 5,170,003 where the mouthpiece comprises an air discharge hole. The same is found in U.S. Pat. No. 3,767,833 which provides a discharge hole with, in addition, an adjustable screw allowing regulation of the discharge of the air. When the air discharge means are provided directly on the pressure sensor, the pressure sensor comprises a discharge port, a pipe being connected to this discharge port and configured to open to the outside of the instrument, either close to the sensor or at the longitudinal end of the instrument. The results of this alternative embodiment remain insufficient however, since the flow of discharged air remains very severely limited. Hence, this type of instrument always requires an adaptation in the manner of playing for the musician who, consequently, cannot change from an electronic wind instrument to an acoustic wind instrument, and vice versa, while maintaining the same playing conditions.

Also known is U.S. Pat. No. 5,140,888, which describes an electronic wind instrument aimed at reproducing the sensations of an acoustic wind instrument. The musical instrument comprises a pipe which extends over the entire length of the instrument, said pipe having an inlet opening onto a mouthpiece (or nozzle) and an outlet allowing the blown air to be discharged. A pressure sensor is connected upstream of the pipe, close to the mouthpiece, and a chamber provided with a valve is arranged between two portions of the pipe, said chamber allowing the flow of air to be adjusted according to the pressure, when the musician blows into the instrument.

Also known is patent application JP 2008-268592A which discloses an electronic wind instrument consisting of a mouthpiece connected to a body of the instrument, said body being independent of the mouthpiece and including an electronic processing system and a keyboard provided with a note selection system. The musical notes are composed according to the breaths generated in the mouthpiece and the selection of notes on the body. The mouthpiece comprises a pressurisation chamber having an inlet, an outlet and a measuring port on which a pressure sensor is connected, disposed on the outside of said chamber and connected to an electronics card which communicates with the body of the instrument. The musician blows into the mouthpiece and manipulates the body independently in order to produce musical notes. Such an instrument does not allow autonomous production of sounds by using only the mouthpiece, because it is compulsory to attach a note selection system, which is implemented on the independent body. The musician cannot therefore experience the sensations of playing an acoustic wind instrument by practising with such an electronic wind instrument.

Also known is U.S. Pat. No. 3,429,986 A which discloses an acoustic instrument comprising a piezoelectric sensor close to the nozzle. This embodiment comprises an effects controller for processing the sounds produced by the acoustic instrument per se, with a view to amplifying same. Such an instrument cannot autonomously produce sounds by independently using the effects controller, because it is compulsory to attach an acoustic instrument. This type of instrument cannot produce the advantages which are mentioned above and sought for an electronic wind instrument.

Also known are patent applications EP 0 039 012 A1 and JP 2014 182277 A which relate to a breath controller designed to be independently connected to a keyboard in such a way as to modify the sound produced by the keyboard. In EP 0 039 012 A1, the breath controller comprises a unique membrane deformed by the action of the breath, and a system for processing the deformation of the membrane. Such breath controllers do not enable autonomous selection of musical notes.

SUMMARY OF THE INVENTION

The invention relates to an electronic wind instrument variant aimed at producing the sensations of an acoustic wind instrument, in other words blowing naturally into the mouthpiece while manipulating the keys in order to produce the notes, as a musician would do with an acoustic wind instrument.

To this end, the invention relates to an electronic wind instrument comprising a body equipped with keys configured to be manipulated with the fingers. Various embodiments are possible for the keys, for example mechanical keys or capacitive keys, the latter being preferred. The body preferably has an elongate ergonomic shape similar to that of acoustic wind instrument such as, for example, a clarinet, a trumpet or a saxophone. Other shapes are however possible.

In the rest of the description, the term instrument defines the electronic wind instrument according to the invention, unless indicated otherwise.

The instrument comprises a mouthpiece (or nozzle) into which the musician blows. This mouthpiece is configured to ensure appropriate holding in the mouth and comprises an inlet port, the cross-section of which is preferably of order 5 $mm^2$ to 20 $mm^2$, which is comparable to a mouthpiece of an acoustic instrument. A channel is arranged in the body, connected to the mouthpiece and leading to the outside of the instrument. Hence, the air blown into the mouthpiece can discharge from the instrument. In addition, at least one pressure sensor is configured on the channel, to be deformed under the action of the breath, and an electronic processing system is connected to the keys and to the pressure sensor. This electronic processing system is configured in order to produce musical notes depending on the contacts or signals generated by manipulation of the keys and by the at least one pressure sensor which deforms during a breath and provides a measurement of the intensity of the breath.

Remarkably, the channel also comprises an inlet tube on which the mouthpiece is connected, an outlet tube which leads to the outside of the instrument, and an intermediate chamber arranged between said inlet and outlet tubes. These three elements are configured to pressurise the chamber when the mouthpiece is blown into. In addition, the chamber comprises a first measuring port on its perimeter, on which the pressure sensor is connected, disposed outside of said chamber.

The above-mentioned features of the instrument enable the inlet tube to have a cross-section which corresponds to that of the tube or cone of an acoustic wind instrument, for example a clarinet, a saxophone or trumpet, which communicates with the inlet cross-section on the mouthpiece (or nozzle). For this purpose, the cross-section of the inlet tube has a diameter of preferably between 10 mm and 30 mm. This inlet tube opens into the chamber which has a cross-section greater than the inlet tube or, in the limit, is of identical cross-section. This avoids any detrimental influence of the chamber on the propagation of the volume of blown air, inside the channel. Due to the arrangement of the measuring chamber directly on the channel of the body of the instrument, and not on the mouthpiece, it is possible to size the chamber, in terms of cross-section and volume, in such a way as to obtain sensations close to the sensations experienced on an acoustic instrument. Furthermore, the architecture of the instrument according to the invention, having a body equipped with keys for producing notes and extended by a mouthpiece into which the musician blows, enables a normal posture of the thorax to be maintained during practice, in such a way as to blow under the same conditions as with an acoustic wind instrument. Hence, by utilising a pressurisation chamber and making measurements on the channel arranged on the body of the instrument, and by keeping the same architecture as an acoustic wind instrument, it is possible to reproduce the same sensation of blowing as with an acoustic instrument. Whereas electronic wind instruments of the prior art do not enable this blowing sensation to be experienced since the volume of blown air remains concentrated in the mouthpiece, optionally discharging via a discharge hole arranged on same, or via a discharge pipe with a very restricted cross-section of order 1 mm to 2 mm.

Furthermore, according to the invention, the intermediate chamber leads to the outlet tube having a smaller cross-section, preferably between 5 mm and 15 mm. This reduction in outlet cross-section ensures a pressure build-up inside the chamber, which enables a significant increase in pressure at the first measuring port on which the pressure sensor is held. Thus, the pressure sensor can easily measure variations in breath in the mouthpiece despite the use of a normal inlet tube cross-section, of order 10 mm to 30 mm, in other words comparable to that of an acoustic instrument. The musician can therefore reproduce a breath similar to that practised on an acoustic wind instrument. In addition, the measurements of breath variations enable the electronic processing system to produce a variable sound once the note is triggered, said processing system being configured for this purpose. The length of the chamber is preferably between 20 cm and 50 cm, and the diameter of the chamber cross-section is between 15 mm et 30 mm, which avoids any influence of the reduction in cross-section on the outlet tube when the musician blows and fills the chamber volume and, thus, makes it possible to have playing sensations which approach as far as possible those of an acoustic wind instrument. These dimensions are provided by way of an example and will be adjusted for each embodiment.

In a preferred embodiment of the instrument, the first measuring port is positioned close to the inlet tube. This makes it possible to improve the response time during a measurement by the pressure sensor.

In a preferred embodiment of the instrument, the first measurement port is positioned on the top of the chamber. This avoids build-up of humidity and condensation by the first measuring port to which the pressure sensor is connected, which reduces the risk of damage to this pressure sensor.

The pressure sensor is connected on the first measuring port arranged on the wall of the chamber, by means of a connection pipe which is arranged perpendicular to the flow of air. The pressure build-up in the chamber advantageously allows the use of a simple or differential pressure sensor. The simple pressure sensor measures the pressure directly at the first measuring port. The differential pressure sensor measures the difference between the pressure at the first measuring port and the outside pressure, allowing the influence of outside conditions to be limited.

In an alternative embodiment, the instrument comprises a second measuring port, the first measuring port and the second measuring port being positioned on two portions of the channel having different cross-sections. In addition, the pressure sensor is a differential pressure sensor which measures the difference between the pressures at the two measuring ports. This design advantageously allows measuring of the pressure difference between two points of the channel, and deducing of a piece of airflow velocity information. In addition, according to this alternative embodiment, the assessment can comprise a third measuring port arranged on a portion of the channel, similar to that of the first and second measuring port, a second differential pressure sensor being connected to this third measuring port and allowing measurement of the difference between the pressure at the third port and the outside pressure. This third measuring port can optionally be combined with the first or second measuring port. Thus, this design allows measuring of the airflow by pressure difference between two measuring points situated at the different cross-sections of the channel, and the addition of the second sensor additionally enables the pressure measurement to be obtained at one of these two points or close by, these two pieces of information being used in order to generate control signals of the sound. A pressure measurement is therefore obtained which is free from the influence of outside conditions and which is completed by an airflow measuring device produced using a differential sensor.

In the case where a differential pressure sensor is connected to the first measuring port in order to measure the difference between the pressure at the first measuring port and the outside pressure, the instrument can comprise, in one embodiment, a second measuring port and a second differential pressure sensor which is arranged at the second measuring port. This second differential pressure sensor measures the difference between the pressure at the second measuring port and the outside pressure. The first and second measuring ports are positioned on two portions of the channel having different cross-sections. This design also enables measuring of the pressure difference between two points of the channel and deduction therefrom of information on the airflow velocity, the processing system retrieving the differential pressure measurements with respect to the outside at the two measuring ports, then calculating the differential pressure between said two ports. This device also enables freedom from the influence of outside conditions on the pressure information measurement.

In an embodiment, the instrument comprises a system for varying the cross-section of the outlet tube, configured in order to vary the flow at the outlet of the channel. In addition, the electronic processing system is configured to adapt according to the adjustment of the said system for varying the cross-section of the outlet tube. This enables the instrument to be adapted as well as possible to the acoustic wind instrument used by the musician, so as to enable the musician to progress as if practising on his own acoustic instrument. In a preferred embodiment, this system for varying the cross-section of the outlet tube consists of a range of inserts, said inserts comprising outlet holes of different diameters. These inserts will constitute the outlet tube once they are mounted by slotting into the chamber.

In an embodiment, the instrument comprises a system for varying the volume of the chamber. In addition, the electronic processing system is configured to adapt according to the adjustment of the said system for varying the volume of the chamber. This allows the playing sensation to be modified, which enables the instrument to behave as different types of acoustic instrument, for example a clarinet, a trumpet or a saxophone. In a preferred embodiment, the system for varying the volume of the chamber consists of a range of inserts, the inserts having an identical outlet hole, which enables a same outlet flow rate to be maintained. In addition, these inserts have different lengths, so as to fill the chamber to different degrees and hence modify the volume of same.

BRIEF DESCRIPTION OF THE FIGURES

The features and advantages of the invention will become apparent on reading the following description of alternative embodiments based on the figures, among which.

DETAILED DESCRIPTION

The following description attempts, in particular, to describe the design of the channel and the realisation of the pressure sensor or sensors on this channel. In the rest of the description, the same references are used to describe the same elements or equivalents thereof according to the various embodiments.

Figure 1:
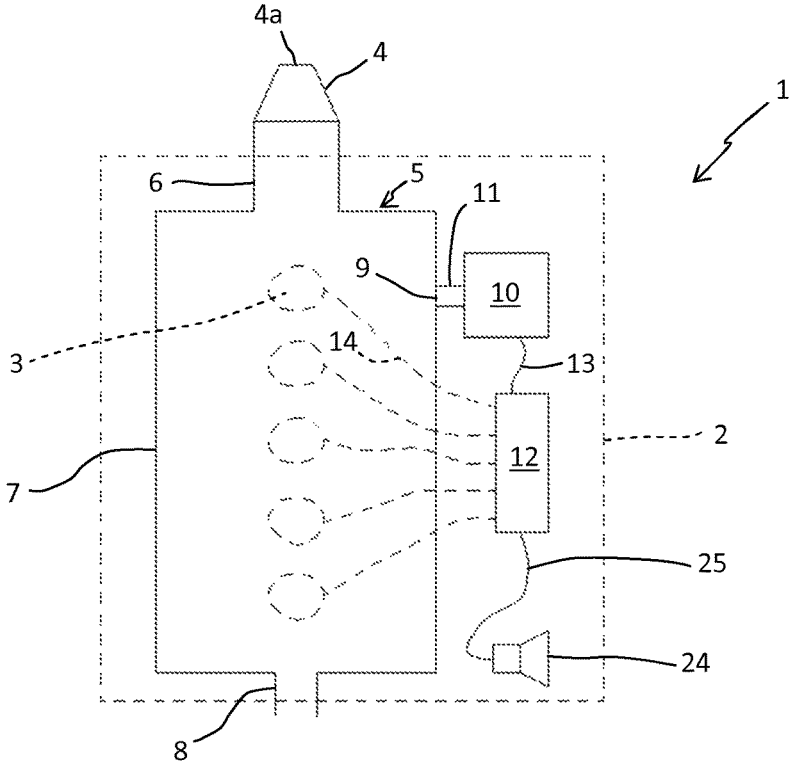
FIGS. 1 to 4 schematically show an instrument according to the invention, in four embodiments.
Figure 2:
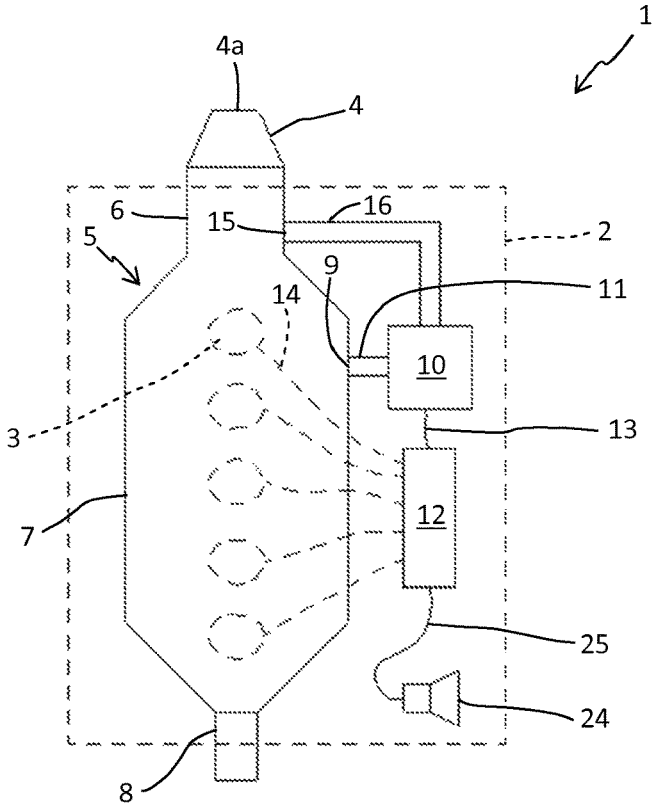
Figure 3:
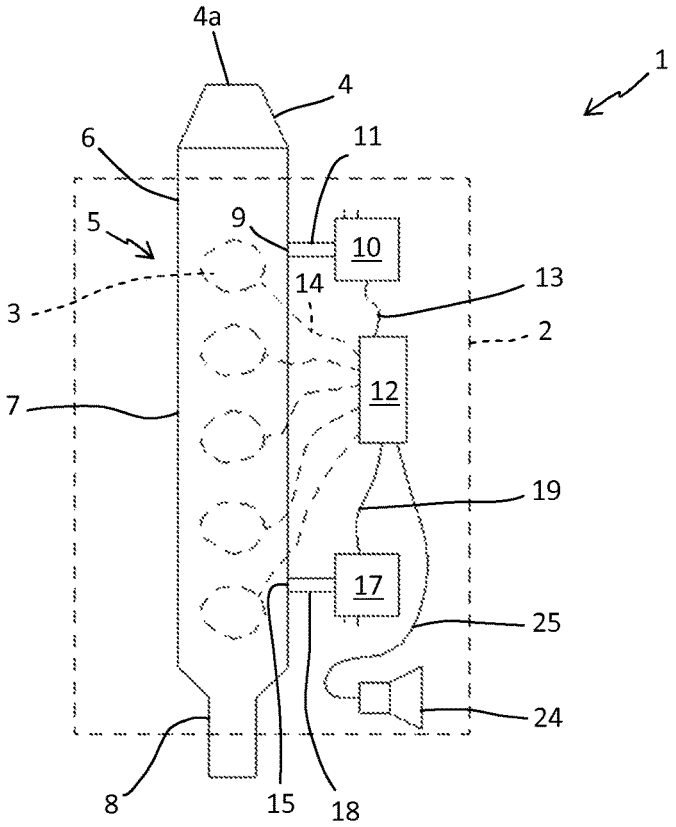

In FIGS. 1 to 3, the instrument 1 comprises a body 2 on which keys 3 are arranged, said elements being illustrated as dashed lines. The body 2 can have various shapes and the keys 3 can have various positions and, for example, will correspond to those of acoustic wind instruments such as a clarinet, a saxophone, a trumpet or others. The keys 3 are preferably capacitive, enabling signals or electrical impulses to be generated on simple contact of the fingers on the keys. Mechanical keys 3 could however also be envisaged, or other technologies for detecting the presence of a finger, without going beyond the scope of the invention.

The instrument 1 comprises a mouthpiece 4 (or nozzle) into which the musician blows. The shape of the mouthpiece 4 will correspond, for example, to that of the acoustic wind instrument also practised by the musician. Other types of mouthpiece are possible, optionally a mouthpiece offset from the body of the instrument and connected to same by means of a flexible or rigid pipe. This mouthpiece 4 comprises an inlet port 4*a* and is connected on a channel 5 which, preferably, extends over the length of the body 2 of the instrument 1, as illustrated in FIGS. 1 to 3. When the musician blows into the mouthpiece 4, the air enters via the inlet port 4*a* then propagates in the channel 5. This inlet port 4*a* has a cross-section for passage of the air of order 5 $mm^2$ to 20 $mm^2$, which is comparable to a mouthpiece of an acoustic instrument.

Figure 4:
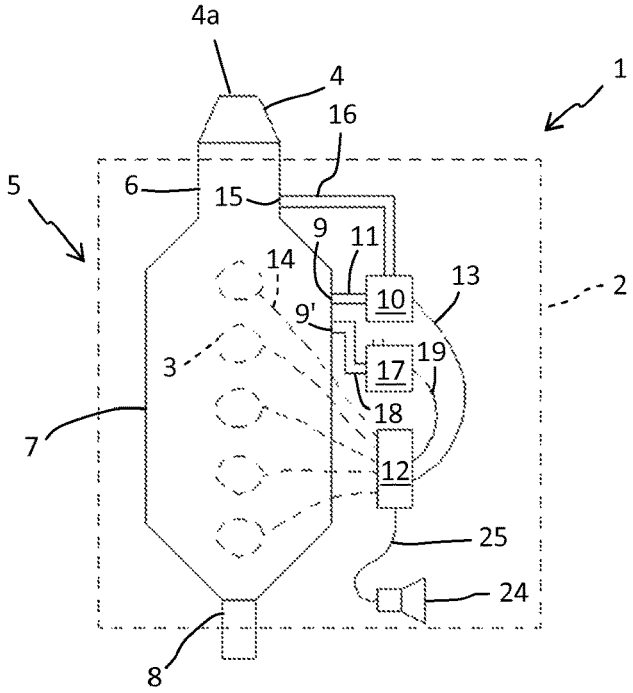

As illustrated in FIGS. 1 to 4, the channel 5 comprises an inlet tube 6 consisting of the upstream portion of said channel 5, the mouthpiece 4 being connected on the inlet tube 6, for example by slotting in. This inlet tube 6 has a cross-section which is preferably circular and has a diameter between 10 mm and 30 mm, this cross-section corresponding substantially to that of an acoustic wind instrument. The channel 5 also comprises a chamber 7 which extends the length of the inlet tube 6, said chamber 7 consisting an intermediate portion of said channel 5. In FIGS. 1, 2 and 4, the chamber 7 has a larger cross-section than the inlet tube 6. While in FIG. 3, the chamber 7 has an identical cross-section 2 to that of the inlet tube 6, which is a limit, the reduction in cross-section upstream being, in this case, directly included in the mouthpiece 4. In this configuration of FIG. 3, the inlet tube 6 and the chamber 7 combine. As illustrated in FIGS. 1 to 4, the channel 5 also comprises an outlet tube 8 disposed in the extension of the chamber 7, this outlet tube 8 constituting the downstream portion of said channel 5. The outlet tube 8 has a cross-section less than that of the chamber 7, the cross-section restriction ensuring a pressure build-up in said chamber 7. This cross-section of the outlet tube 8 is preferably circular and has a diameter of between 5 mm and 15 mm. The chamber 7 has a cross-section which is preferably circular and between 15 mm and 30 mm. In addition, this chamber 7 has a length of between 20 cm and 50 cm. This design advantageously allows the pressure to be increased in the chamber 7 by a sufficiently large amount to allow pressure measurements to be carried out by means of basic pressure sensors, of the simple pressure sensor type or differential preferential pressure sensors, as specified in the following description. In addition, this design makes it possible to increase the dynamic of pressures observed in the channel 5, bring them into more easily measurable value ranges, making it easier to distinguish the variations of breath of the musician in the mouthpiece 4. This design also allows the blown air to propagate along the channel without any break linked to the presence of a restriction in the channel 5, the maintaining of a cross-section of the inlet tube 6 similar to that of an acoustic wind instrument allowing the same sensations to be maintained as with the acoustic instrument.

As illustrated in FIG. 1, the chamber 7 comprises, in the upstream part of same, a first measuring port 9, on which a pressure sensor 10 is connected by means of a pipe 11. The measuring port is positioned in the first half of the chamber 9, as illustrated in FIG. 1, adjoining the tube inlet 6. This pressure sensor 10 can be a simple pressure sensor measuring the pressure directly at the measurement port 9. This pressure sensor 10 can also be, in an embodiment, a differential pressure sensor measuring the difference between the pressure at the measuring port 9 and pressure outside the instrument 1. This pressure sensor 10 transmits a signal proportional to the measurement performed, the signal being transmitted to a processing system 12 by means of an electrical cable 13. The keys 3 are also connected to the processing system 12 via electrical cables 14, the keys 3 transmitting electrical signals to said processing system 12 during contact with the fingers of the musician. The embodiment of FIG. 1 can also be envisaged with a channel 5 having an inlet tube 6 and a chamber 7 with identical cross-sections, said elements being combined and forming the pressurisation chamber connected directly to the mouthpiece 4 which has a reduced cross-section up to its inlet port 4*a*.

In the embodiment illustrated in FIG. 2, the first measuring port 9 is arranged upstream of the chamber 7, in the first half thereof, the channel 5 comprising a second measuring port 15 which is arranged on the inlet tube 6. In addition, the pressure sensor 10 is a differential pressure sensor that is connected both to the first measuring port 9 by means of the pipe 11 as well as to the second measuring port 15 by means of a second pipe 16. The pressure sensor 10 measures the difference in pressure between the pressure at the first measuring port 9 and that at the second measuring port 15. This pressure sensor 10 is connected to the processing system 12. The second measuring port 15 can be arranged at other locations on the channel 5, for example downstream of the chamber 7, in the second half thereof.

In the embodiment illustrated in FIG. 3, the first measuring port 9 it arranged upstream of the chamber 7, in the first half thereof. As explained above, this chamber 7 incorporates the inlet tube 6. A second measuring port 15 is arranged, for example, downstream of the chamber 7, in the second half thereof. In addition, a first pressure sensor 10 is connected on the first measuring port 9 by means of the pipe 11, and a second pressure sensor 17 is connected on the second measuring port 15 by means of a pipe 18, these two pressure sensors 10, 17 being differential pressure sensors, each connected to the processing system 12 by means of electric cables 13, 19. The first pressure sensor 10 measures the pressure difference between the pressure at the first measuring port 9 and that outside the body 2 of the instrument 1. Likewise, the second pressure sensor 17 measures the pressure difference between the pressure at the second measuring port 15 and that outside the body 2 of the instrument 1. This design provides the pressure in the chamber at two points of the chamber 7, but also provides the pressure difference between these two-point measurement points.

In the embodiment of FIG. 4, the instrument 1 incorporates all the features described above for FIG. 2, and additionally comprises a third measuring port 9' which is connected to a second differential pressure sensor 17 by means of the pipe 18. This second pressure sensor 17 measures the pressure difference between the pressure at the third measuring port 9' and that outside the body 2 of the instrument 1. This third measuring port 9' is arranged close to the first measuring port 9, on a portion of the channel 5 with identical cross-section. This design provides the difference in pressure between these two measuring points, as well as the pressure close to one of these two measuring points. It is also possible to combine the third measuring port 9' with the first measuring port 9. Likewise, it is possible to position this third measuring port 9' close to the second measuring port 15.

Figure 5:
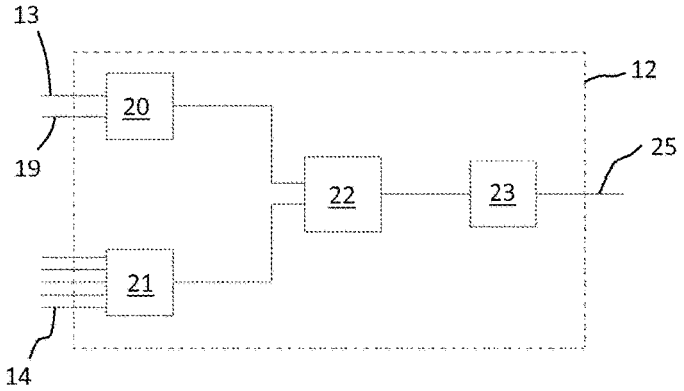
FIG. 5 schematically shows a processing system on the instrument according to the invention.

According to the embodiments illustrated in FIGS. 1 to 4, the processing system 12 is configured to process the data received from the pressure sensor or pressure sensors 10, 17 and keys 3, and to provide as output a response curve similar to that of the sound response of an acoustic wind instrument. By way of example, illustrated in FIG. 5, the processing system 12 comprises a first cell 20 processing pressure measurement signals coming from the pressure sensor or sensors 10, 17, for example a signal conditioning circuit may include means for adapting the dynamic of the signals using an analogue to digital converter. Likewise, the processing system 12 comprises a second cell 21, for example a detection circuit for detecting the capacitive keys using QTouch® technology from Atmel®, transmitting information when the fingers are in contact with the keys 3 of the instrument 1, when these keys 3 are of capacitive type. These cells 20, 21 then transmit the data to a microcontroller computer 22, which incorporates a computer program for producing the sound response curve as a function of the received data. Many embodiments can be envisaged within the scope of a person skilled in the art, depending on the technologies used for the pressure sensors 10, 17 and for the keys 3, these components being able to be directly integrate technologies configured to transmit the information directly to the computer 22. The computer 22 can also directly integrate technologies and/or program additions enabling the information from said components to be processed. When the musician blows into the mouthpiece 4 and manipulates the keys 3, the program is configured to determine the measurement from which to trigger a new musical note and the measurement from which to stop same, while using all the intermediate values to vary the expression of the sound rendered by playing with the sound volume as well as with other elements of the timbre of the sound produced. The program can also be configured to carry out more elaborate processing, allowing the physical behaviour of an acoustic instrument to be simulated. The capacity of the instrument 1 to augment the observed pressure dynamics enables the computer 22 to vary this response curve according to the variations of blowing into the mouthpiece 4. This response curve is then processed by a third sound synthesiser processing cell 23, which can be in the form of a hardware or virtual cell (software running on a computer), associated with a sound reproduction device ranging from a simple amplifier/headset pair to a complex sound system. This processing cell 23 reconstitutes signals and transmits them to a loudspeaker 24 by means of an electrical cable 25, as illustrated in FIGS. 1 to 4 and 6. A person skilled in the art is able to program the computer 22 to reproduce the sound response curve.

Figure 6A:
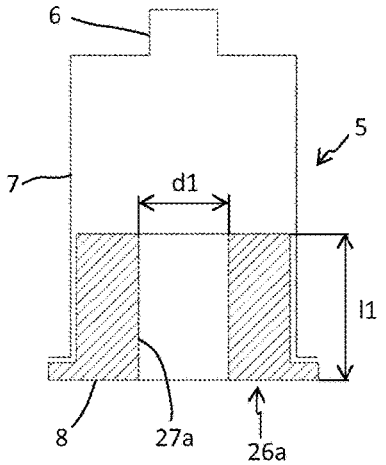
FIGS. 6A and 6B schematically illustrate a channel of an instrument according to the invention, highlighting a system for varying the cross-section of the outlet tube.
Figure 6B:
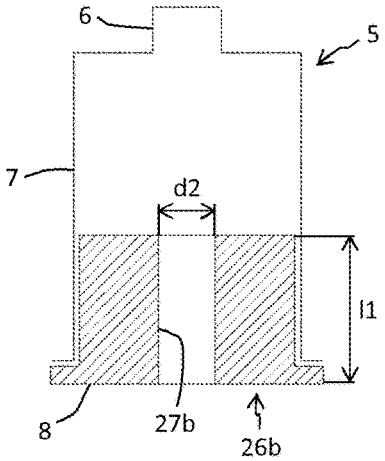

An embodiment of the instrument 1 according to the invention comprises a system for varying the cross-section of the outlet tube 8, as illustrated in FIGS. 6A and 6B. In FIG. 6A, the channel 5 comprises a first insert 26*a* which constitutes the outlet tube 8. This first insert 26*a* is slotted into the chamber 7 over a length l1 and has a through-hole 27*a* of diameter d1. In FIG. 6B, a second insert 26*b* is slotted into the chamber 7 replacing the first insert 26*a* of FIG. 6A, this second insert 26*b* also has a length of l1 and a through hole 27*b* of diameter d2, different from diameter d1. The flow in the outlet tube 8 is thus adapted according to the insert 26*a*, 26*b* used. In this case, the instrument 1 will use the means for configuring the processing system 12 in order to adapt the behaviour of said processing system according to the insert 26*a*, 26*b* used. Hence, the instrument 1 can be best adapted to the acoustic wind instrument used by musician.

Figure 7A:
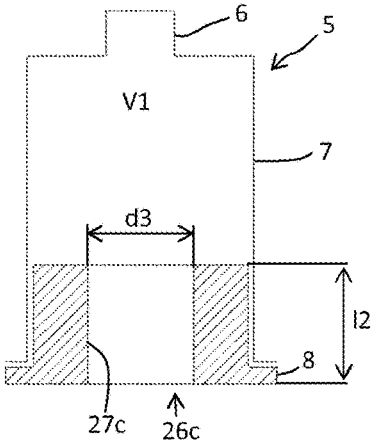
FIGS. 7A and 7B schematically show a channel of an instrument according to the invention, highlighting a system for varying the volume of the chamber.
Figure 7B:
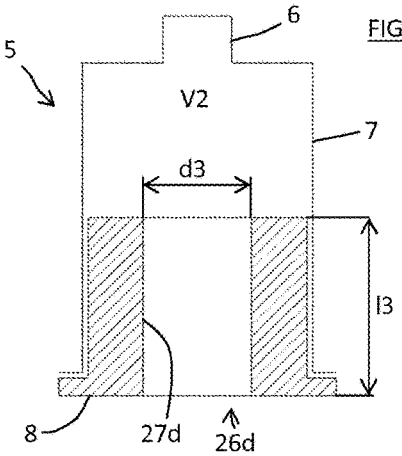

An embodiment of the instrument 1 according to the invention comprises a system for varying the volume inside the chamber 7, as illustrated in FIGS. 7A and 7B. In FIG. 7A, the channel 5 comprises a first insert 26*c* which constitutes the outlet tube 8. This first insert 26*c* is slotted in the chamber 7 over a length l2 and comprises a through-hole 27*c* of diameter d3. Thus the chamber 7 has a first volume V1. In FIG. 7B, a second insert 26*d* is slotted into the chamber 7, replacing the first insert 26*c* of FIG. 7A, this second insert 26*d* has a length l3 different from length l2 of the first insert 26*c*, and a through-hole 27*d* also having diameter d3. Thus the chamber 7 has a second volume V2. The change in volume inside the chamber 7, by the use of such inserts 26*c*, 26*d*, advantageously allows modification of the playing sensation when the musician blows into the instrument 1. Hence, the instrument 1 can be adapted to different types of instrument, for example a clarinet, a trumpet or a saxophone. In this case, the instrument 1 will use the means for configuring the processing system 12 in order to adapt the behaviour of said processing system according to the insert 26*c*, 26*d* used.

Also possible is an embodiment of instrument 1 combining the systems for varying the cross-section of the outlet tube 8 and the volume of the chamber 7, described above. For example, in the embodiment of FIGS. 6A and 6B, the second insert 26*b* could have a different length from length l1 of the first insert 26*a*. Similarly, in the embodiment of FIGS. 7A and 7B, the second insert 26*d* could have a different diameter from diameter d3 of the first insert 26*c*.

The detailed description above of the embodiments of instrument 1 is in no way limiting. On the contrary, it aims to remove any possible imprecision regarding its scope. Thus, many embodiments can be envisaged within the context of the invention, in particular regarding the position of the measuring ports 9 and 15. Their positioning upstream of the chamber 7, as illustrated in FIGS. 1 and 2, have the advantage of improving the response times by reducing said times, when taking a measurement using the pressure sensor 10. Preferably, the measuring ports 9, 15 will be positioned on the upper side (the top) of the chamber 7, in order to avoid the build-up of moisture in the pressure sensor or pressure sensors 10 and 17. This upper side is defined relative to the position of the instrument 1 when it is brought to the mouth in order to play music. The dimensions of the inlet tube 6, of the chamber 7 and of the outlet tube 8, as well as the cross-section of the passage of the inlet port 4*a* of the mouthpiece 4, can be adapted depending on the type of acoustic musical wind instrument to which the instrument 1 should approximate.

The invention claimed is:

1. An electronic wind instrument comprising a mouthpiece into which the musician blows, a body provided with keys and a channel connected to the mouthpiece and leading to the outside of the instrument, at least one pressure sensor configured to deform under the action of breath, and an electronic processing system connected to the keys and the pressure sensor and configured to produce musical notes according to the manipulating of the keys and the measurement of a breath, wherein the channel extends over the length of the body of the instrument, said channel comprising an inlet tube on which the mouthpiece is connected, and an outlet tube which leads to the outside of the instrument and a chamber arranged between said inlet and outlet tubes, said elements being configured to pressurise the chamber when the musician blows into the mouthpiece, said chamber comprising, on the periphery of same, a first measuring port on to which the pressure sensor is connected, disposed on the outside of said chamber.

2. The electronic wind instrument according to claim 1, wherein the first measuring port is positioned close to the inlet tube.

3. The electronic wind instrument according to claim 1, wherein the first measuring port is positioned on top of the chamber.

4. The electronic wind instrument according to claim 1, wherein the pressure sensor is a simple pressure sensor which measures the pressure at the first measuring port.

5. The electronic wind instrument according to claim 1, wherein the pressure sensor is a differential pressure sensor which measures the difference between the pressure at the first measuring port and the outside pressure.

6. The electronic wind instrument according to claim 5, comprising a second measuring port, a second differential pressure sensor being arranged at the second measuring port.

7. The electronic wind instrument according to claim 1, comprising a second measuring port, the first measuring port and the second measuring port being positioned on two portions of the channel having different cross-sections, the pressure sensor being a differential pressure sensor which measures the difference between the pressures at said two measuring ports.

8. The electronic wind instrument according to claim 7, comprising a third measuring port arranged close to one or other of the first and second measuring ports, a second differential pressure sensor being arranged at the third measuring port in order to measure the pressure difference at this point with respect to the outside.

9. The electronic wind instrument according to claim 1, comprising a system for varying the cross-section of the outlet tube configured to vary the flow at the outlet of the channel, the processing system being configured to adapt according to the adjustment of the system for varying the cross-section of the outlet tube.

10. The electronic wind instrument according to claim 9, wherein the system for varying the cross-section of the outlet tube consists of a range of inserts, said inserts having outlet holes of different diameters.

11. The electronic wind instrument according to claim 1, comprising a system for varying the volume of the chamber, the processing system being configured to adapt according to the adjustment of the system for varying the volume of the chamber.

12. The electronic wind instrument according to claim 11, wherein the system for varying the volume of the chamber consists of a range of inserts, said inserts having an outlet hole of identical diameter and being of different length.

* * * * *